US011118529B2

(12) United States Patent
Schröder et al.

(10) Patent No.: US 11,118,529 B2
(45) Date of Patent: Sep. 14, 2021

(54) DRIVE SYSTEM, MOTOR VEHICLE, AND METHOD FOR OPERATING A DRIVE SYSTEM

(71) Applicant: Volkswagen Aktiengesellschaft, Wolfsburg (DE)

(72) Inventors: Ulrich Schröder, Braunschweig (DE); Michael Tomforde, Gifhorn (DE); Christian Dierschke, Goslar (DE); Johannes Forst, Hannover (DE); Daniel Leineweber, Braunschweig (DE)

(73) Assignee: VOLKSWAGEN AKTIENGESELLSCHAFT, Wolfsburg (DE)

( * ) Notice: Subject to any disclaimer, the term of this patent is extended or adjusted under 35 U.S.C. 154(b) by 0 days.

(21) Appl. No.: 16/286,092

(22) Filed: Feb. 26, 2019

(65) Prior Publication Data

US 2019/0264630 A1 Aug. 29, 2019

(30) Foreign Application Priority Data

Feb. 27, 2018 (DE) ..... 10 2018 104 454.2

(51) Int. Cl.
*F02D 41/30* (2006.01)
*F02D 43/00* (2006.01)
(Continued)

(52) U.S. Cl.
CPC ..... *F02D 41/3076* (2013.01); *F02D 41/263* (2013.01); *F02D 41/3064* (2013.01);
(Continued)

(58) Field of Classification Search
CPC ..... F02D 41/3076; F02D 41/263; F02D 41/3064; F02D 43/00; F02D 43/04;
(Continued)

(56) References Cited

U.S. PATENT DOCUMENTS 6,386,180 B1 * 5/2002 Gerhardt ..... F02D 41/1497 123/350
6,394,063 B1 * 5/2002 Volz ..... F02D 41/263 123/295

(Continued)

FOREIGN PATENT DOCUMENTS

CN 104685172 6/2015
CN 107264508 10/2017

(Continued)

OTHER PUBLICATIONS

Search report for German Patent Application No. 10 2018 104 454.2, dated Jul. 16, 2018.

(Continued)

*Primary Examiner* — Logan M Kraft
*Assistant Examiner* — John D Bailey
(74) *Attorney, Agent, or Firm* — Pearl Cohen Zedek Latzer Baratz LLP

(57) ABSTRACT

A drive system for driving a motor vehicle has an internal combustion engine and an operating mode coordination device for determining and controlling the operating mode of the internal combustion engine. The drive system has a function coordination device for coordinating secondary functions of the drive system, the function coordination device being designed for generating, based on the coordination of the secondary functions, an operating mode request for the operating mode coordination device for controlling the operating mode of the internal combustion engine, and transmitting it to the operating mode coordination device. The invention further relates to a motor vehicle having a drive system, and a method for operating a drive system of a motor vehicle.

8 Claims, 3 Drawing Sheets

(51) Int. Cl.

| | |
|---|---|
| ***F02D 41/26*** | (2006.01) |
| ***F02D 43/04*** | (2006.01) |
| *F02D 41/02* | (2006.01) |
| *F02D 41/14* | (2006.01) |
| *F02D 41/00* | (2006.01) |
| *F02D 41/22* | (2006.01) |

(52) U.S. Cl.
CPC ..... *F02D 43/00* (2013.01); *F02D 43/04* (2013.01); *F02D 41/0085* (2013.01); *F02D 41/024* (2013.01); *F02D 41/029* (2013.01); *F02D 41/1438* (2013.01); *F02D 41/221* (2013.01); *F02D 41/222* (2013.01); *F02D 2041/1418* (2013.01)

(58) Field of Classification Search
CPC .. F02D 41/0085; F02D 41/024; F02D 41/029; F02D 41/1438; F02D 41/221; F02D 41/222; F02D 2041/1418
USPC ..... 123/294
See application file for complete search history.

(56) References Cited

U.S. PATENT DOCUMENTS 6,539,915 B1 * 4/2003 Wild ..... F02D 41/263 123/295
7,536,241 B2 * 5/2009 Bellmann ..... G05B 15/02 701/1
2006/0047404 A1 * 3/2006 Blankenhorn ..... F02D 41/021 701/103
2015/0114326 A1 * 4/2015 Burkhardt ..... F01M 13/023 123/41.86
2017/0291593 A1 * 10/2017 Iwagami ..... B60W 10/11
2018/0066595 A1 * 3/2018 Dudar ..... F02D 41/0037

FOREIGN PATENT DOCUMENTS

| | | | |
|---|---|---|---|
| DE | 19850586 | A1 | 5/2000 |
| DE | 199 06 378 | A1 | 8/2000 |
| DE | 10 2004 041 217 | A1 | 3/2006 |
| DE | 10 2005 018 270 | A1 | 10/2006 |
| DE | 10 2011 078 484 | B4 | 4/2013 |
| DE | 10 2013 223 319 | A1 | 5/2015 |
| DE | 10 2014 209 316 | A1 | 11/2015 |
| JP | 2017214885 | | 12/2017 |

OTHER PUBLICATIONS

Extended European Search report for European Patent Application No. EP 19 159 018, dated Jul. 25, 2019.
Office Action for Chinese Application No. 201910140565.2, dated May 31, 2021.

* cited by examiner

DRIVE SYSTEM, MOTOR VEHICLE, AND METHOD FOR OPERATING A DRIVE SYSTEM

CROSS REFERENCE TO RELATED APPLICATION

This application claims priority from German Patent Application No. 10 2018 104 454.2, filed Feb. 27, 2018, which is incorporated herein by reference in its entirety.

FIELD OF THE INVENTION

The invention relates to a drive system for driving a motor vehicle. The invention further relates to motor vehicle having a drive system according to the invention. Lastly, the invention relates to a method for operating a drive system of a motor vehicle according to the invention.

BACKGROUND OF THE INVENTION

Recent motor vehicles having an internal combustion engine include an engine control unit with an operating mode coordination device for controlling the internal combustion engine. Operating modes of the internal combustion engine are controllable by means of the operating mode coordination device. Thus, for example, a fuel mixture, the injection pressure of the fuel, the duration of the fuel injection, or the like are controllable in a targeted manner. In addition to these parameters that directly determine the operating mode of the internal combustion engine, a number of other tasks such as diagnostics, adaptation, and other functions are executed to ensure proper operation of the internal combustion engine. These tasks are also referred to as secondary functions. In the secondary functions, a distinction is made between active secondary functions and passive secondary functions. Active secondary functions have a direct effect on the operating mode of the internal combustion engine, while the operating mode remains unaffected by passive secondary functions.

Since at least some secondary functions are executable only under special conditions, i.e., only in certain operating modes, it is possible that operating modes that are suitable for a first secondary function are unsuitable for a second secondary function, and vice versa. This is referred to as competing secondary functions. For example, tank venting has a direct effect on the fuel mixture in the injection tract, and therefore should not be carried out at the same time as diagnostics of the lambda probe.

A method for controlling the execution of a plurality of functions in a motor vehicle is known from DE 10 2013 223 319 A1. The functions are prioritized based on a base priority and a need indicator that is output by the function, and are enabled according to their priority. DE 10 2011 078 484 B4 discloses a system for controlling a combustion state of an internal combustion engine, in which a prioritization of functions takes place based on operating states of the internal combustion engine. DE 10 2005 018 270 A1 relates to a method for controlling an internal combustion engine, wherein operating modes of the internal combustion engine may be specified by means of an operating mode coordinator. The operating mode coordinator is designed for selecting, from a plurality of operating mode requests, an operating mode that has a high priority and that is not ruled out by other requested operating modes.

The known methods and devices described above have the disadvantage that the execution requests for the functions to be executed are always transmitted directly to the operating mode coordination unit, which is responsible for specifying the operating modes. The operating mode coordination unit thus has the additional task of specifying the operating modes as a function of the execution requests. Highly complex software that is precisely coordinated with the secondary functions and the possible operating modes is necessary for this purpose. In addition, in existing drive systems, secondary functions may be blocked or terminated by secondary functions with higher priority, so that proper execution of the secondary functions is not ensured.

SUMMARY OF THE INVENTION

The object of the present invention, therefore, is to provide a drive system for driving a motor vehicle, a motor vehicle having a generic drive system, and a method for operating a drive system of a motor vehicle that do not have, or that do not have at least in part, the disadvantages of the prior art. The object of the present invention in particular is to provide a drive system, a motor vehicle, and a method with which execution of competing secondary functions is improved in a simple and cost-effective manner.

The above object is achieved by the patent claims. Accordingly, the object is achieved by a drive system for driving a motor vehicle as claimed, by a motor vehicle having a drive system as claimed, and by a method for operating a drive system of a motor vehicle as claimed. Further features and details of the invention result from the subclaims, the description, and the drawings. Of course, features and details that are described in conjunction with the drive system according to the invention also apply in conjunction with the motor vehicle according to the invention and the method according to the invention, and vice versa in each case, so that with regard to the disclosure, mutual reference is or may always be made to the individual aspects of the invention.

According to the first aspect of the invention, the object is achieved by a drive system for driving a motor vehicle. The drive system has an internal combustion engine and an operating mode coordination device for determining and controlling the operating mode of the internal combustion engine. According to the invention, the drive system has a function coordination device for coordinating secondary functions of the drive system. The function coordination device is designed for generating, based on the coordination of the secondary functions, an operating mode request for the operating mode coordination device for controlling the operating mode of the internal combustion engine, and transmitting it to the operating mode coordination device.

The operating mode coordination device is designed for selecting and controlling the operating modes or the operating parameters of the internal combustion engine. The drive system preferably has at least one sensor, at least one valve, at least one pump, at least one fuel tank, at least one purge bypass of the fuel tank, and at least one exhaust gas purification device or the like according to a conventional drive system.

The function coordination device is designed for coordinating secondary functions of the drive system. Within the scope of the invention, secondary functions include, for example, diagnostics, adaptation, and other functions that are executed to ensure proper operation, or to optimize the operation, of the internal combustion engine.

Within the scope of diagnostics, it may be determined, for example, whether a sensor, such as a lambda probe for comparing the residual oxygen content of the exhaust gas to the instantaneous oxygen content of the ambient air, or a high-pressure sensor for determining a rail pressure in an injection line, a valve such as a purge valve of a purge circuit for venting a fuel tank of a motor vehicle, a pump such as a purge pump for facilitating venting of the fuel tank, or the like is functioning properly or is defective, i.e., no longer functioning properly. A sensor may experience soiling or erosion, for example, and thus produce incorrect measuring results. As the result of soiling and/or wear, a valve may no longer be able to fully close or may have high inertia, for example. In addition, soiling and wear may result in reduced power of a pump, and thus, generation of lower maximum pressures and a lower delivery mass flow.

Adaptation is understood to mean, for example, an adjustment to altered basic conditions. One example is the balancing of fuel quantities for the individual cylinders of the internal combustion engine. This is necessary due to the fact that, on account of wear, the rail pressure in individual injection lines may be lower than in other injection lines. This may be determined within the scope of quantity balancing diagnostics, using pressure sensors. When a localized pressure drop is recorded, it may be compensated for in the course of the adaptation.

Within the scope of the invention, another function is tank venting, for example. For this purpose, motor vehicles have a vent duct, for example, which fluidically connects an air space of the fuel tank to an air intake duct of the internal combustion engine. Fluid mass flow through the vent duct is controllable via a purge valve and/or a purge pump.

The drive system preferably has a memory device in which data for the secondary functions as well as for the operating modes necessary for carrying out the particular secondary function are stored, and which may be read out by the function coordination device. Operating states of the drive system may be determined by means of the function coordination device. For this purpose, the function coordination device is preferably coupled to a sensor system of the drive train and/or to position sensors or the like in order to quickly determine the particular active operating state within the scope of an actual state query. The function coordination device is preferably designed for receiving and coordinating requests for secondary functions. Based on this coordination, the function coordination device is designed for generating an operating mode request that fulfills or takes into account, for example, an instantaneous operating state and/or the required adaptation of the operating state for carrying out a specific secondary function. The operating mode request may be designed, for example, as an operating mode strategy having a chronological sequence of different operating modes. Lastly, the function coordination device is designed for relaying the generated operating mode request to the operating mode coordination device. The operating mode coordination device is designed for selecting an operating mode based on the received operating mode request. The function coordination device and the operating mode coordination device are preferably designed as part of an engine control unit for controlling the internal combustion engine.

A drive system according to the invention has the advantage over conventional drive systems that the execution of secondary functions is improved in a cost-effective manner, using simple means. By coordinating different active secondary functions and passive secondary functions by means of the function coordination device, a specific operating mode request is relayable to the operating mode coordination device, so that data flow to the operating mode coordination device is significantly reduced. Requests for competing secondary functions may be easily identified by means of the function coordination device and taken into account in generating the operating mode request. Reliability in the execution of secondary functions may be improved in this way. In addition, premature termination of a secondary function due to an operating mode request for a competing secondary function may be better avoided.

According to one preferred refinement of the invention, it may be provided that the function coordination device is designed for prioritizing secondary functions and operating modes of the internal combustion engine. In the prioritization, secondary functions are preferably compared to one another, and the importance of executing the particular secondary functions is preferably weighted. For example, a potential time period for executing secondary functions, i.e., a period of time within which the particular secondary function is to be executed, may be taken into account to ensure proper operation of the drive system. The function coordination device is preferably configured for generating the operating mode request for the operating mode coordination device, and relaying it to same, based on the prioritization. It may thus be ensured that particularly important secondary functions are executed within a predefined time frame, and less important secondary functions are either initiated at a later point in time, or are initially terminated, depending on an expected run time of the particular less important secondary function.

The function coordination device is preferably designed for using a diagnostic function of the drive system as the secondary function. The diagnostic function may be active, i.e., bringing about a change in the operating mode, or passive, i.e., functioning in one or more operating modes of the drive system during normal operation. Diagnostic functions are necessary for the proper operation of the drive system, for example to determine a defect in a component, to control the efficiency of a unit, or the like. Stability and reliability of the diagnostics may be improved in a cost-effective manner, using simple means, by the coordination of diagnostic functions by the function coordination device.

According to the invention, it may be provided that the function coordination device is designed for coordinating a sensor diagnostics unit of a sensor of a catalytic converter of the motor vehicle and/or a sensor diagnostics unit of a sensor of an injection line and/or a purge system diagnostics unit of a purge system of a fuel tank of the motor vehicle as the diagnostic function. By using diagnostics on the sensor of the catalytic converter, in particular the lambda probe, it may be ensured that the catalytic converter is also operated properly and performs optimal filtering of pollutants such as $NO_X$. Via the diagnostics on the sensor of the injection line, in particular a pressure sensor for measuring a pressure in the injection line, it may be ensured that the cylinders are acted on uniformly and properly by the fuel-air mixture. By use of the purge system diagnostics unit of the purge system of the fuel tank, in particular a pressure sensor for measuring a pressure in a purge line, a purge valve for opening and closing the purge line, and a purge pump for pumping the fluid through the purge line, it may be ensured that proper tank venting takes place.

The function coordination device is preferably designed for coordinating an adaptation function of a basic function of the internal combustion engine, in particular quantity balancing for cylinders of the internal combustion engine, as the secondary function. In an adaptation function, for example effects of wear are compensated for by adjusting operating parameters. For a worn valve, which in a defined position permits a lower throughput due to wear, within the scope of the adaptation function the valve position may be changed in such a way that the throughput once again attains the setpoint value. In quantity balancing, pressures in the injection lines of the cylinders are compared to one another, and pressure drops at individual cylinders are detected and readjusted to the normal level by the adaptation function. Coordinating adaptation functions by means of the function coordination device has the advantage that the execution of competing adaptation functions and/or other secondary functions, such as diagnostic functions or the like, is improved.

According to one preferred refinement of the invention, it may be provided that the function coordination device is designed for coordinating venting of a fuel tank of the motor vehicle and/or mixture adaptation and/or catalytic converter heating and/or particle filter heating and/or particle filter regeneration and/or checking the fuel system and/or monitoring lambda control deviations as the secondary function. The venting of the fuel tank and the mixture adaptation are competing secondary functions, for which it makes sense not to execute them at the same time. In addition, the other secondary functions may influence one another, and therefore in principle should not be executed at the same time. Joint coordination of the fuel tank venting and the mixture adaptation by means of the function coordination device ensures that these secondary functions may be executed as reliably as possible. In addition, these secondary functions together with competing secondary functions, such as diagnostics or adaptation, may be coordinated by means of the function coordination device, thus improving reliability of the drive system.

According to a second aspect of the invention, the object is achieved by a motor vehicle having a drive system. The drive system has a design that corresponds to a drive system according to the invention, and thus has at least one internal combustion engine and an operating mode coordination device for determining and controlling the operating mode of the internal combustion engine. In addition, the drive system of the motor vehicle has a function coordination device for coordinating secondary functions of the drive system, the function coordination device being designed for generating, based on the coordination of the secondary functions, an operating mode request for the operating mode coordination device for controlling the operating mode of the internal combustion engine, and transmitting it to the operating mode coordination device.

All advantages that have been described above for the drive system according to the first aspect of the invention also result for the described motor vehicle. Accordingly, the motor vehicle according to the invention has the advantage over conventional motor vehicles that the execution of secondary functions is improved in a cost-effective manner, using simple means. By coordinating different active secondary functions and passive secondary functions by means of the function coordination device, a specific operating mode request is relayable to the operating mode coordination device, so that data flow to the operating mode coordination device is significantly reduced. Requests for competing secondary functions may be easily identified by means of the function coordination device and taken into account in generating the operating mode request. Reliability in the execution of secondary functions may be improved in this way. In addition, premature termination of a secondary function due to an operating mode request for a competing secondary function may be better avoided.

According to a third aspect of the invention, the object is achieved by a method for operating a drive system of a motor vehicle according to the invention. The method has the following steps:

- determining an operating mode of the internal combustion engine by means of the operating mode coordination device,
- determining the operating mode of the internal combustion engine by means of the function coordination device,
- determining, by means of the function coordination device, secondary functions of the drive system that are to be executed,
- prioritizing the determined secondary functions by means of the function coordination device,
- generating an operating mode request for the operating mode coordination device by means of the function coordination device, based on the prioritization,
- relaying the operating mode request to the operating mode coordination device by means of the function coordination device,
- implementing the operating mode request by the operating mode coordination device, and
- enabling the execution of at least one secondary function by the function coordination device, based on the prioritization and the instantaneous operating mode of the drive system.

The operating mode coordination device is designed for selecting and specifying the operating mode of the internal combustion engine or the drive system. The determination of the operating mode may thus take place at the same time as the specifying of the operating mode. Alternatively or additionally, the operating mode may be determined by a sensor system. The instantaneously specified operating mode is determined by the function coordination device, for example by querying the sensor system and/or communicating with the function coordination device. In addition, secondary functions of the drive system that are to be executed are determined by means of the function coordination device. This may take place, for example, via an active query by the function coordination device for the particular secondary functions and/or according to a predefined function plan. Alternatively or additionally, the secondary functions may be designed for transmitting an instantaneous execution intent to the function coordination device. The function coordination device subsequently carries out a prioritization of the determined secondary functions to identify particularly important or urgently required secondary functions. Based on this prioritization, the function coordination device generates the operating mode request for the operating mode coordination device and relays it to the operating mode coordination device. The operating mode coordination device will preferably implement this operating mode request immediately so as not to hinder proper execution of the secondary functions. After the operating mode request is implemented, the function coordination device authorizes enabling of the particular secondary functions that can be carried out in the operating mode and that do not mutually exclude one another. The enabling of competing secondary functions preferably takes place in a time-delayed manner, so that these secondary functions are not executed at the same time.

All advantages that have been described above for the drive system according to the first aspect of the invention and the motor vehicle according to the second aspect of the invention also result for the described method. Accordingly, the method according to the invention has the advantage over conventional methods that the execution of secondary functions is improved in a cost-effective manner, using simple means. By coordinating different active secondary functions and passive secondary functions by means of the function coordination device, a specific operating mode request is relayable to the operating mode coordination device, so that data flow to the operating mode coordination device is significantly reduced. Requests for competing secondary functions may be easily identified by means of the function coordination device and taken into account in generating the operating mode request. Reliability in the execution of secondary functions may be improved in this way. In addition, premature termination of a secondary function due to an operating mode request for a competing secondary function may be better avoided.

The prioritization of the secondary functions preferably takes place as a function of the instantaneous operating mode and/or a predicted operating mode. This is particularly important for secondary functions which in principle are classified as equivalent, and thus would obtain essentially the same prioritization. In this way, enabling of secondary functions for which an intervention into the operating modes of the drive system is not necessary may be favored. [By] taking into account predicted operating modes, determined, for example, by communication between the function coordination device and the operating mode coordination device, secondary functions may obtain a higher prioritization when they can be carried out in the pending, predicted operating mode. In this case as well, an additional intervention into the operating modes may be avoided.

According to the invention, in a method it may be provided that in the generation of the operating mode requests by means of the function coordination device, potential operating modes for executing the prioritized secondary functions are compared to one another, and an operating mode request is generated that also takes into account the execution of lower-priority secondary functions. In other words, the operating mode request is generated in such a way that a preferably extensive execution of secondary functions is possible. For example, when a secondary function with the highest priority is executable in operating modes A through C, a lower-priority secondary function is executable only in operating mode D, and an even lower-priority secondary function is executable only in operating mode C, the operating mode request would be based on operating mode C to allow the parallel execution of at least two secondary functions. Also executing lower-priority secondary functions may be ensured in this way.

BRIEF DESCRIPTION OF THE DRAWINGS

A drive system according to the invention, a motor vehicle according to the invention, and a method according to the invention are explained in greater detail below with reference to the drawings, which schematically show the following.

DETAILED DESCRIPTION OF THE INVENTION

Figure 1:
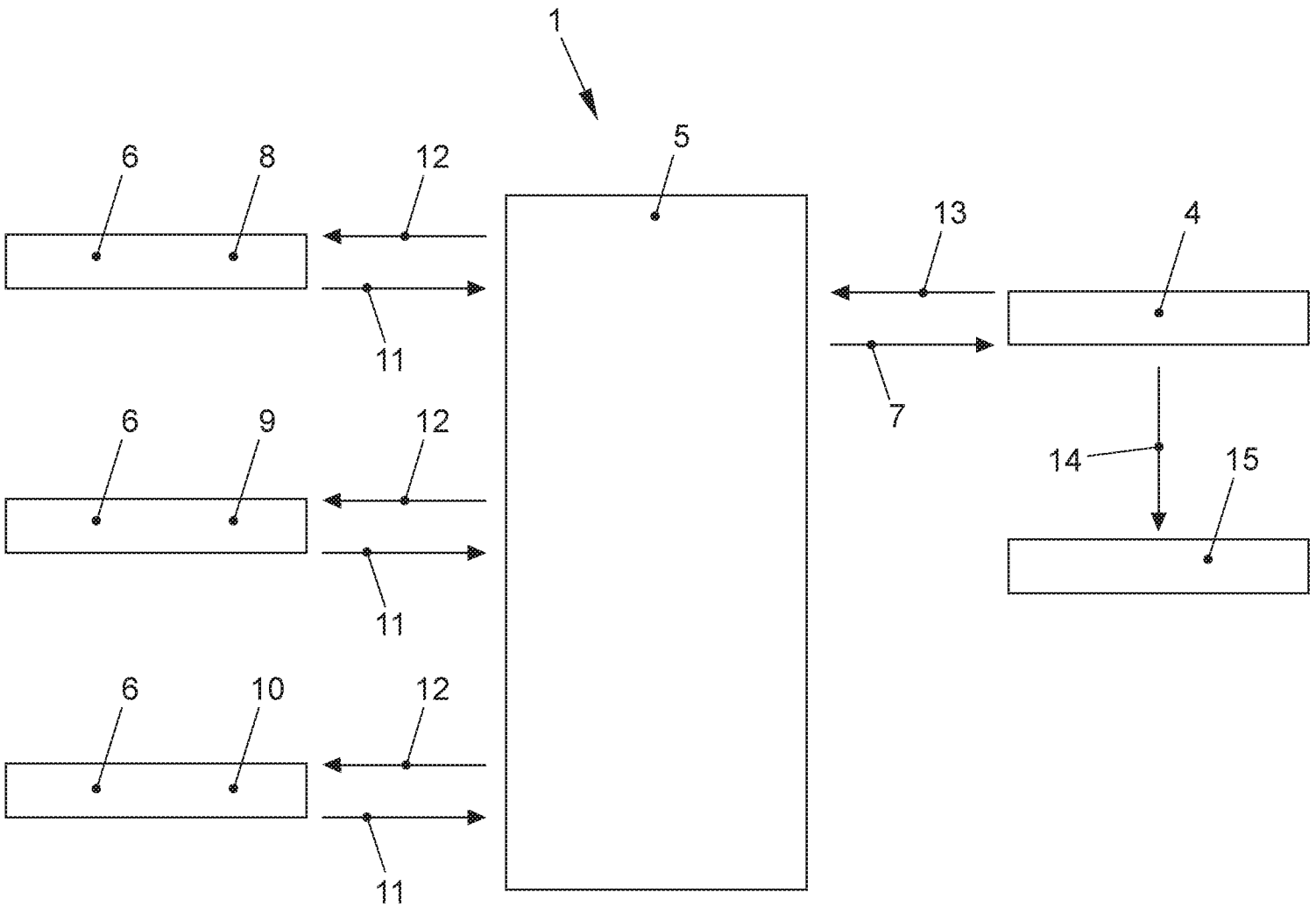
FIG. 1 shows a structure of one preferred embodiment of a drive system according to the invention.
Figure 2:
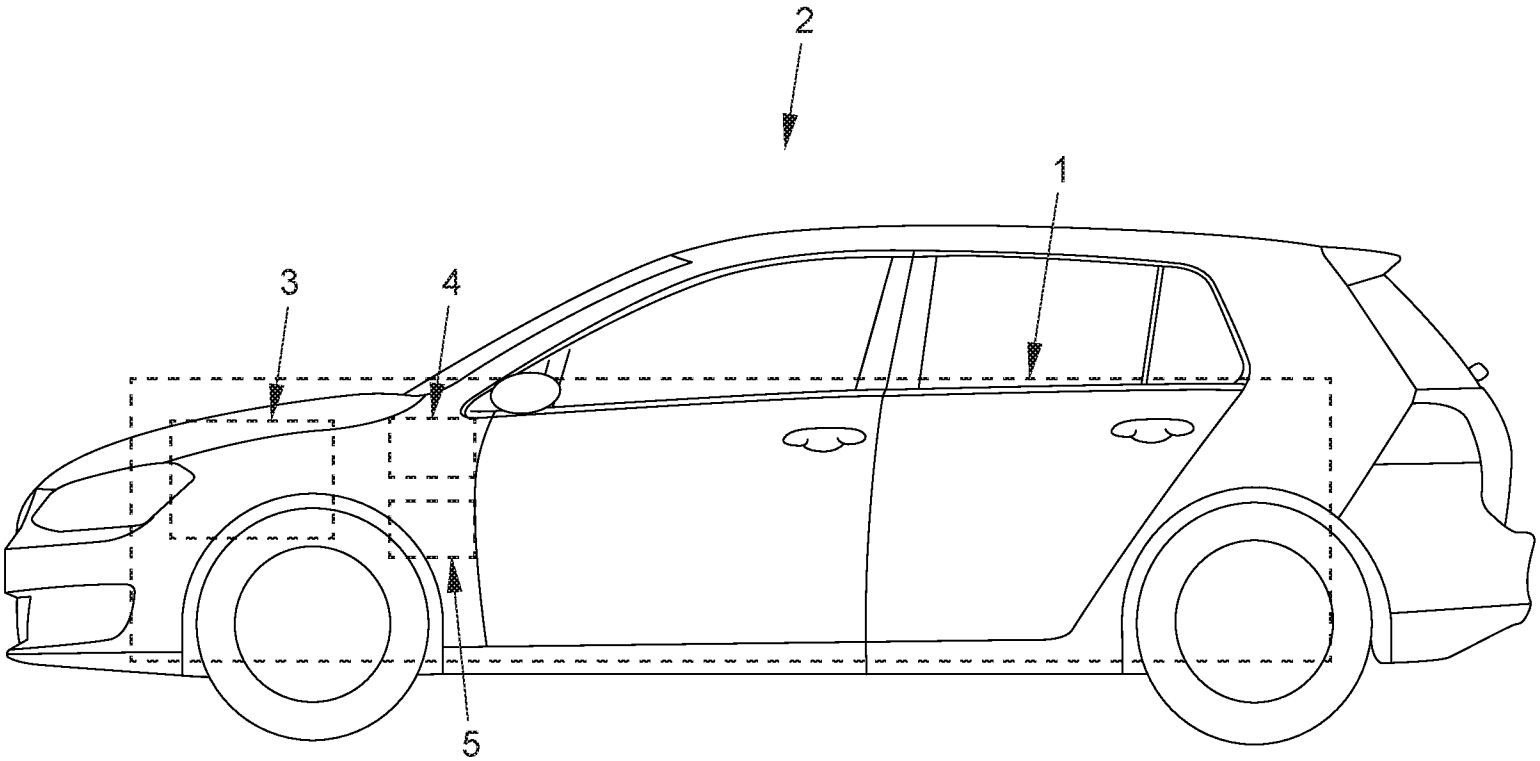
FIG. 2 shows a side view of one preferred embodiment of the motor vehicle according to the invention.
Figure 3:
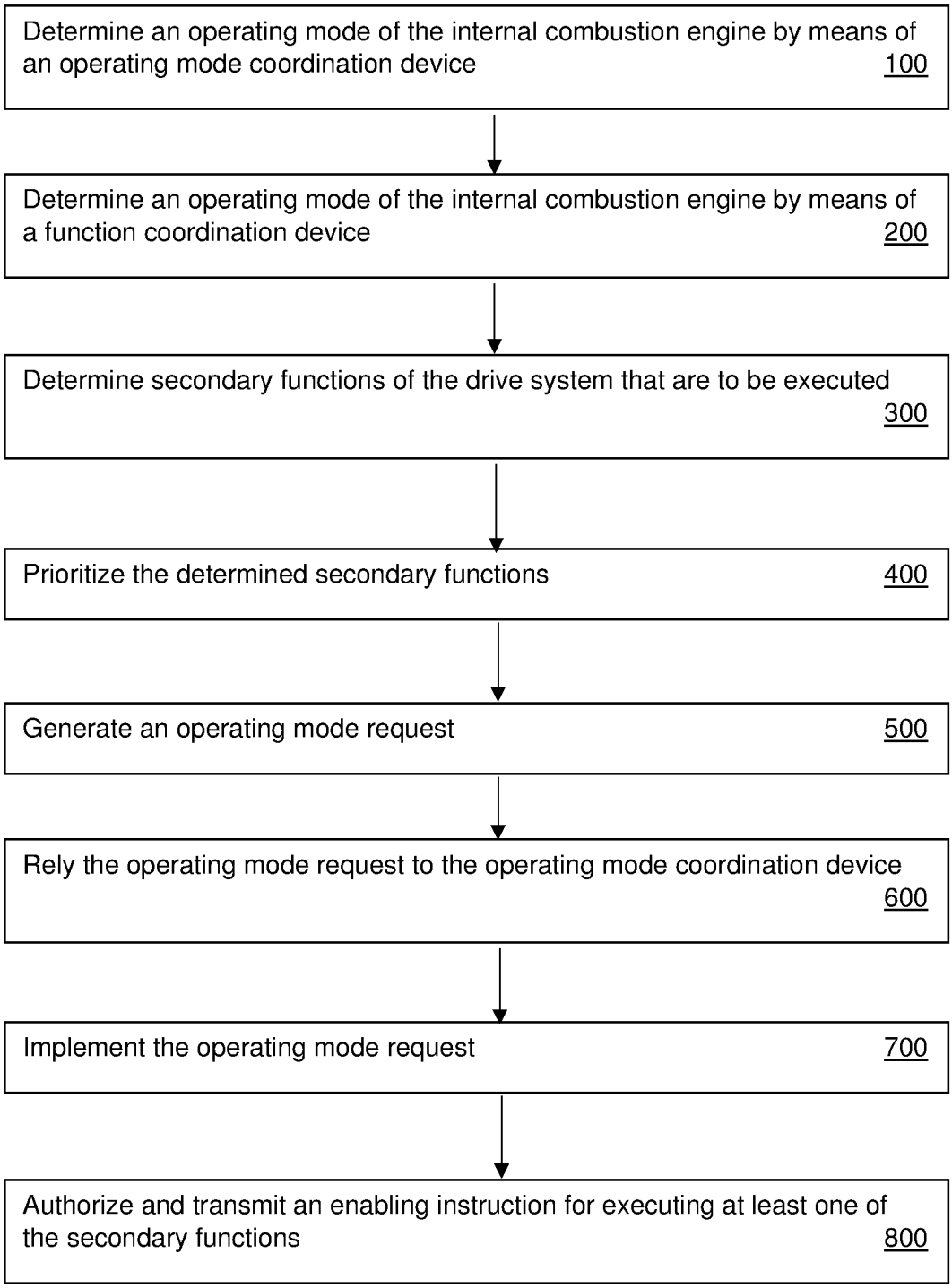
FIG. 3 shows a flow chart of one preferred embodiment of the method according to the invention.

Elements having identical functions and operating principles are provided with the same reference numerals in each of FIGS. 1 through 3.

FIG. 1 schematically illustrates a structure of one preferred embodiment of the drive system 1 according to the invention. The drive system 1 has an operating mode coordination device 4 for relaying an operating mode control command 14 to operating mode actuators 15 of the drive system 1. The operating modes of the drive system 1 are settable via the operating mode actuators 15. In this exemplary embodiment, the operating mode coordination device 4 is designed for relaying the instantaneous operating mode of the drive system 1 to a function coordination device 5 of the drive system 1 by an operating mode transmission unit 13. Alternatively or additionally, the function coordination device 5 may be used for independently determining the operating mode, for example via a direct connection to a sensor system and/or at least one operating mode actuator 15 of the drive system 1. Multiple secondary functions 6 such as diagnostic functions 8, adaptation functions 9, or other secondary functions 10 are executable in the drive system 1. The secondary functions 6 are designed for relaying a request 11 to the function coordination device 5 for the desired execution of the particular secondary function 6. The function coordination device 5 is designed for coordinating the requests 11 and for generating an operating mode request 7 based on the coordination of the requests 11. In addition, the function coordination device 5 is designed for relaying the operating mode request 7 to the operating mode coordination device 4. Furthermore, the function coordination device 5 is designed for transmitting an enabling instruction 12 to the corresponding secondary functions 6 as a function of the instantaneous operating mode and the coordination of the requests 11, so that the particular secondary function 6 is executable.

FIG. 2 schematically illustrates one preferred embodiment of the motor vehicle 2 according to the invention with a drive system 1 according to the invention, in a side view. The drive system 1 has an internal combustion engine 3, an operating mode coordination device 4, and a function coordination device 5.

FIG. 3 shows a flow chart of one preferred embodiment of the method according to the invention. An operating mode of the internal combustion engine 3 is determined by means of the operating mode coordination device 4 in a first method step 100. The operating mode of the internal combustion engine 3 is determined by means of the function coordination device 5, for example by communication with the operating mode coordination device 4 and/or querying of sensors or operating mode actuators 15, in a second method step 200. Secondary functions 6 of the drive system 1 that are to be executed are determined by means of the function coordination device 5 in a third method step 300, for example by accepting a request 11 for the secondary function 6 and/or according to a predefined secondary function plan. The determined secondary functions 6 are prioritized, for example based on the importance of the secondary function 6 and/or the executability in the instantaneous operating mode, in a fourth method step 400 by means of the function coordination device 5. An operating mode request 7 for the operating mode coordination device 4 is generated in a fifth method step 500 by means of the function coordination device 5, based on the prioritization. The operating mode request 7 is relayed to the operating mode coordination device 4 in a sixth method step 600 by means of the function coordination device 5. The operating mode request 7 is implemented in a seventh method step 700 by means of the operating mode coordination device 4. An enabling instruction 12 for executing at least one secondary function 6 is authorized in an eighth method step 800 by means of the function coordination device 5 based on the prioritization and the instantaneous operating mode of the drive system 1, and is transmitted to the particular secondary function 6.

LIST OF REFERENCE NUMERALS

1 drive system
2 motor vehicle
3 internal combustion engine
4 operating mode coordination device
5 function coordination device
6 secondary function
7 operating mode request
8 diagnostic function
9 adaptation function
10 other secondary function
11 request
12 enabling instruction
13 operating mode transmission unit
14 operating mode control command
15 operating mode actuator

The invention claimed is:

1. A drive system for driving a motor vehicle, comprising:
an internal combustion engine,
an operating mode coordination device for determining and controlling an operating mode of the internal combustion engine,
a function coordination device for coordinating secondary functions of the drive system, the function coordination device being designed for:
generating, based on the coordination of the secondary functions, an operating mode request for the operating mode coordination device for controlling the operating mode of the internal combustion engine, and
transmitting the operating mode request to the operating mode coordination device,
wherein the function coordination device is designed for prioritizing secondary functions and operating modes of the internal combustion engine, and
wherein the prioritization of the secondary functions takes place as a function of an instantaneous operating mode and/or a predicted operating mode,
wherein the secondary functions obtain a higher prioritization when they can be carried out in the predicted operating mode which is pending.

2. The drive system according to claim 1, wherein the function coordination device is designed for coordinating a diagnostic function of the drive system as the secondary function.

3. The drive system according to claim 2, wherein the function coordination device is designed for coordinating a sensor diagnostics unit of a sensor of a catalytic converter of the motor vehicle and/or a sensor diagnostics unit of a sensor of an injection line and/or a purge system diagnostics unit of a purge system of a fuel tank of the motor vehicle as the diagnostic function.

4. The drive system according to claim 1, wherein the function coordination device is designed for coordinating an adaptation function of a basic function of the internal combustion engine, in particular balancing of fuel quantities for cylinders of the internal combustion engine, as the secondary function.

5. The drive system according to claim 1, wherein the function coordination device is designed for coordinating venting of a fuel tank of the motor vehicle and/or mixture adaptation and/or catalytic converter heating and/or particle filter heating and/or particle filter regeneration and/or checking the fuel system and/or monitoring lambda control deviations as the secondary function.

6. A motor vehicle having a drive system, wherein the drive system is designed according to claim 1.

7. A method for operating a drive system of a motor vehicle according to claim 6, having the following steps:
determining an operating mode of the internal combustion engine by means of the operating mode coordination device,
determining the operating mode of the internal combustion engine by means of the function coordination device,
determining, by means of the function coordination device, secondary functions of the drive system that are to be executed,
prioritizing the determined secondary functions by means of the function coordination device,
generating an operating mode request for the operating mode coordination device by means of the function coordination device, based on the prioritization, relaying the operating mode request to the operating mode coordination device by means of the function coordination device,
implementing the operating mode request by the operating mode coordination device, and
enabling the execution of at least one secondary function by the function coordination device, based on the prioritization and the instantaneous operating mode of the drive system.

8. The method according to claim 7, wherein, in the generation of the operating mode requests by means of the function coordination device, potential operating modes for executing the prioritized secondary functions are compared to one another, and an operating mode request is generated that also takes into account the execution of lower-priority secondary functions.

* * * * *